US006588844B1

(12) United States Patent
Stenzel

(10) Patent No.: US 6,588,844 B1
(45) Date of Patent: Jul. 8, 2003

(54) CHAIR WIT TILTABLE SEAT

(75) Inventor: Thomas Stenzel, Waldshut-Tiengen (DE)

(73) Assignee: Sedus Stoll AG, Waldshut-Tiengen (DE)

( * ) Notice: Subject to any disclaimer, the term of this patent is extended or adjusted under 35 U.S.C. 154(b) by 0 days.

(21) Appl. No.: 10/059,418

(22) Filed: Jan. 31, 2002

(51) Int. Cl.[7] ..... A47C 1/032; A47C 1/024

(52) U.S. Cl. ..... 297/300.2; 297/301.1; 297/316; 297/320

(58) Field of Search ..... 297/300.2, 300.4, 297/301.1, 316, 320, 321, 284.4; 248/292.12

(56) References Cited

U.S. PATENT DOCUMENTS 4,471,994 A * 9/1984 Zund et al. ..... 297/300.3
4,834,454 A * 5/1989 Dicks ..... 297/317
4,986,601 A * 1/1991 Inoue ..... 297/300.4
5,689,999 A * 11/1997 Wiley et al. ..... 74/527
6,334,651 B1 * 1/2002 Duan et al. ..... 297/284.4
6,402,239 B1 * 6/2002 Haglund ..... 297/216.13
6,431,649 B1 * 8/2002 Hensel ..... 297/300.2
6,439,661 B1 * 8/2002 Brauning ..... 297/300.2

FOREIGN PATENT DOCUMENTS

EP 0 509 693 10/1992
EP 1 002 484 5/2000
WO WO 9220262 A1 * 11/1992 ..... A47C/1/032

* cited by examiner

*Primary Examiner*—Peter M. Cuomo
*Assistant Examiner*—Stephen D'Adamo
(74) *Attorney, Agent, or Firm*—Oblon, Spivak, McClelland, Maier & Neustadt, P.C.

(57) ABSTRACT

A chair has both a tiltable seat and a tiltable backrest mounted on a backrest support. The chair includes a pedestal mounted on a bottom of the tiltable seat. An eccentric disk is seated in the pedestal so as to be movable therein. A rod eccentrically penetrates the eccentric disk via a prismatically-shaped cross-section recess through the eccentric disk so that the rod is not movable with respect to the eccentric disk. A handle is connected on an outer end of the rod for use in turning the rod together with the eccentric disk. An arm is mounted on the backrest support of the tiltable backrest, wherein the rod is seated in the arm in a movable manner.

7 Claims, 4 Drawing Sheets

CHAIR WIT TILTABLE SEAT

BACKGROUND OF THE INVENTION

1. Field of the Invention

The present invention generally relates to a chair with a tiltable seat and more particularly, to a chair with a tiltable seat and a tiltable backrest mounted on a backrest support.

2. Discussion of Background

Chairs with tiltable seats and tiltable backrests are known, for example, from any of the publications, as follow: EP-A 0834271; EP-B 0489961; and EP-B 0233974. The chairs known from these publications have tiltable seats and tiltable backrests, wherein the seat and the backrest are forceably connected to each other via a so-called "synchronized mechanism." These chairs have a great track record in practice. However, they are not optimal in that the user is dependent upon the connection of the angles of inclination of seat and backrest as specified by the synchronized mechanism. The user is not able to adjust the backrest tilt to a certain position, and to change the inclination of the seat in such a position.

The present invention is meant to resolve the above-stated problem with conventional chairs having tiltable seats and tiltable backrests.

SUMMARY OF THE INVENTION

An object of the present invention is to provide a chair having a tiltable seat and a tiltable backrest such that the inclination of the tiltable seat can be adjusted individually, independent from the inclination specified by a synchronized mechanism which depends upon the tilt of the tiltable backrest. Such a chair is important not only for office areas, where the user must be able to adjust the chair under ergonomic aspects to his respective working position, but also in private applications, where the user wants to be able to adjust the respective seat and backrest inclination for relaxation purposes. Further, the present invention provides a chair that is simple in design, is easy to manufacture in the production process, and has a visually aesthetically satisfactory effect.

The object of the present invention is accomplished by providing a chair with tiltable seat and a tiltable backrest both of which are mounted on a backrest support of the backrest of the chair. The chair includes a pedestal mounted on a bottom of the tiltable seat. The pedestal includes an eccentric disk seated in an articulating or movable manner. The eccentric disk is penetrated eccentrically by a rod connected with the eccentric disk in a stationary manner (i.e., the rod is hexagonal and penetrates a hexagonal aperture in the disk so that the rod is not movable with respect to the disk). The rod includes a handle for turning the rod, wherein the handle is mounted on an outer end of the rod. An arm is provided so as to extend upwardly from the backrest support and the rod is seated in the arm in an articulating or movable manner. The rod has a prismatic cross-section (i.e., hexagonal) and penetrates the eccentric disk in a first prismatic cross-section recess (i.e., hexagonal). The handle has a second prismatic cross-section recess (i.e., hexagonal) and with this second prismatic cross-section recess, the handle can be pushed onto an end of the prismatic cross-section rod in a stationary manner (i.e., the is no movement at the connection between the handle and the rod). The prismatic cross-section of the rod and first and second prismatic cross-sectional recesses are hexagonal in shape. The eccentric disk has an outer shell surface which has a lug thereon. In an end position of the eccentric disk, the lug rests against a stop in the pedestal. The stop in the pedestal is offset by more than 180° in relation to the lowest bearing point of the lug.

When the seat is supported by the backrest support of the backrest, the distance between the seat and the backrest support can be changed manually by a simple eccentric bearing. While it is true that the seat basically follows the inclination of the backrest, the seat can still additionally be adjusted individually with regard to its inclination in a fixed position of the backrest.

BRIEF DESCRIPTION OF THE DRAWING FIGURES

The present invention is explained in more detail in the following based on one example shown in the drawing figures, wherein.

Figure 1:
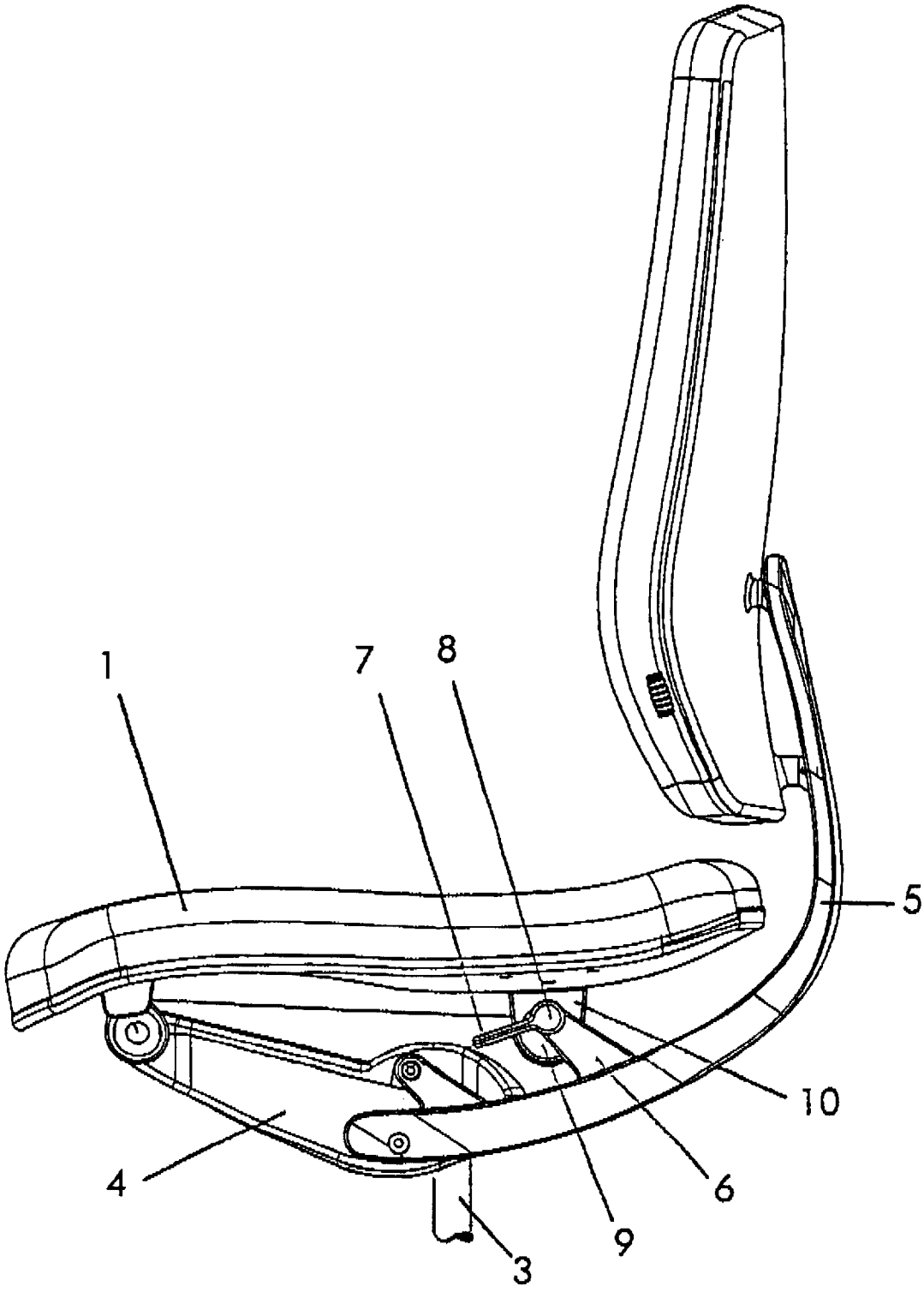
FIG. 1 is a side elevational view of a chair with a seat that is lowered (i.e., flat inclination or tilt of the seat) in accordance with the present invention.
Figure 2:
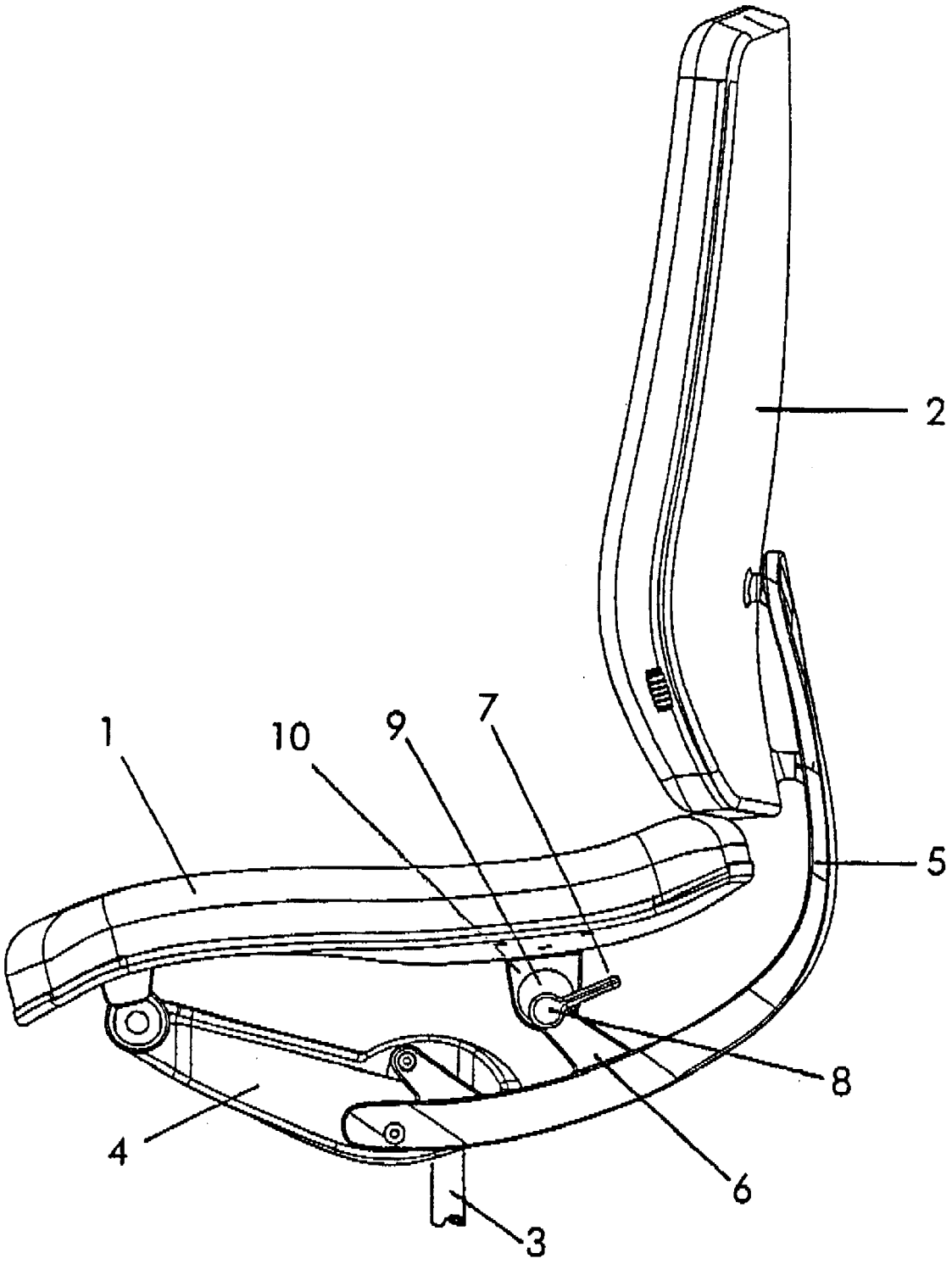
FIG. 2 is a side elevational view of the chair, similar to in FIG. 1, except with a more tilted seat (i.e., steeper inclination)
Figure 3:
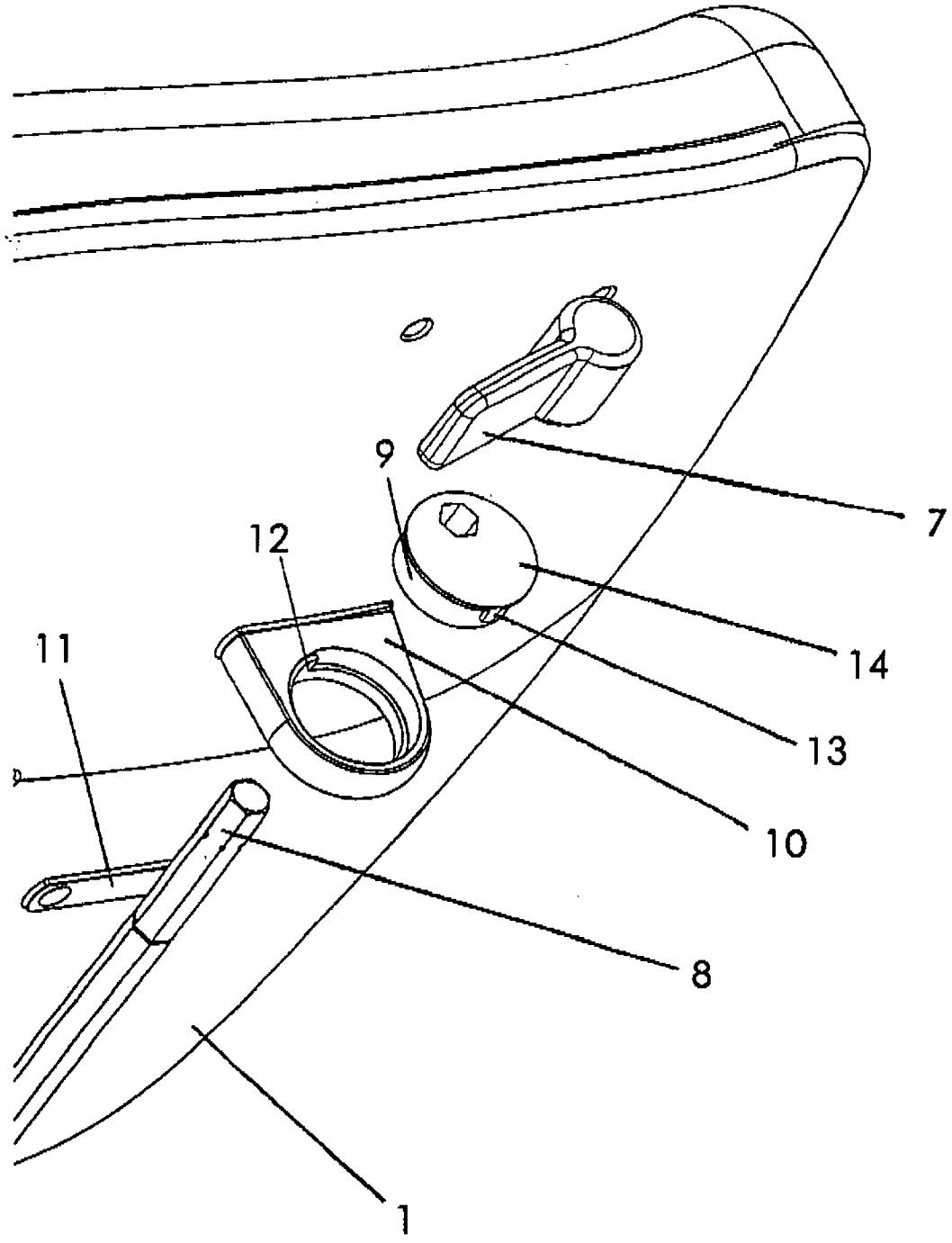
Figure 4:
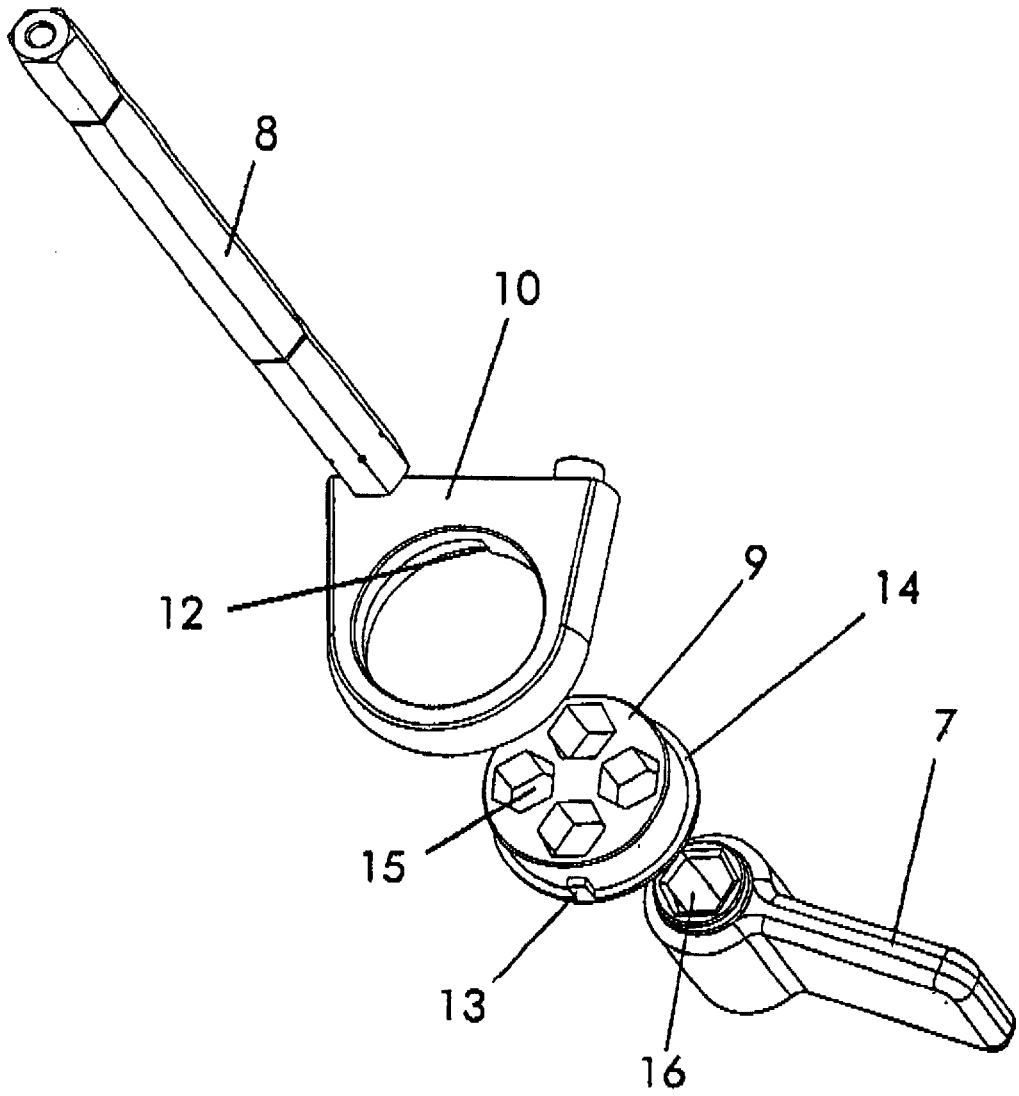

FIG. 3 is partial perspective view of the bottom of the tiltable seat 1 of the chair, shown in FIGS. 1 and 2, with an exploded view of the handle 7, front plate 14, eccentric disk 9, pedestal 10, rod 8, and bearing 11 and having the arm 6, which is attached to the backrest support 5, removed from its in-use position of between the front plate 14 of the eccentric disk 9 and the handle 7 for clarity of view; and FIG. 4 is an exploded perspective view of the handle 9, front plate 14, eccentric disk 9, pedestal 10, rod 8, and bearing 11 being illustrated from a different angle than that shown in FIG. 3 and having the arm 6, which is attached to the backrest support 5, removed from its in-use position of between the front plate 14 of the eccentric disk 9 and the handle 7 for clarity of view.

DETAILED DESCRIPTION OF THE PREFERRED EMBODIMENTS

Referring to FIGS. 1 and 2, the main components of the chair are: the tiltable seat 1; the tiltable backrest 2 with the backrest support 5; the tilt mechanism in the housing 4; and the base 3.

The tiltable seat 1 and the backrest support 5, with a tiltable backrest 2, are forceably coupled, via the tilt mechanism in the housing 4 and the articulated connection of the seat 1, to the backrest support 5 in a conventional manner (i.e., as shown in FIG. 1) or else by means of their tilt (i.e., as shown in FIG. 2). Thus, if the tiltable backrest 2, and with it the backrest support 5, are tilted back, the tiltable seat 1 is also lowered (i.e. flatter inclination as shown in FIG. 1).

However, referring to FIGS. 3 and 4, the articulated or movable connection of the tiltable seat 1 to the backrest support 5, in accordance with the present invention, includes: arm 6; handle 7; rod 8; eccentric disk 9; pedestal 10; bearing 11; stop 12 (in pedestal 10); lug 13 (on eccentric cam 9); front plate 14 (on eccentric disk 9) hexagonal recess 15 (in eccentric disk 9); and hexagonal recess 16 (in handle 7).

The pedestal 10 is provided on the bottom of the tiltable seat 1. The eccentric disk 9 is seated in an articulating or movable manner in the pedestal 10. The eccentric disk 9 is penetrated eccentrically by a rod 8. The rod 8 has a hexagonal cross-section and penetrates a hexagonal recess 15 in the eccentric disk 9 so that the rod 8 is not movable within the hexagonal recess 15 of the eccentric disk 9 (i.e., the rod is stationary with respect to the eccentric disk 9). The handle 7 is mounted on the outer end of the rod 8. The handle 7 is used to turned the rod 8. A bearing 11 is connected or attached to rod 8, as shown in FIG. 3, and the rod 8 is seated in the arm 6 (the arm being shown in FIGS. 1 and 2 and the arm 6 having been removed from between the front plate 14 of the eccentric disk 9 and the handle 7 in FIGS. 3 and 4 for clarity of view). The arm 6 is fastened to the backrest support 5.

The stationary connection of the rod 8 with the eccentric disk 9 and the handle 7 is achieved by designing the rod 8 to be of prismatic or hexagonal cross-section so that the rod 8 penetrates the prismatic or hexagonal recesses 15 of the eccentric 9 and the prismatic or hexagonal recess 16 of the handle 7.

As shown in particular in FIGS. 1 and 2, the bearing (11, shown only in FIG. 3) attached to the rod 8 seated in the arm 6 can be moved more upwardly (FIG. 1 showing the seat lowered in its flatter inclination) or more downwardly (FIG. 2 showing the seat raised in its steeper inclination) by rotating the handle 7. This makes the inclination of the tiltable seat 1 flatter (FIG. 1) or steeper (FIG. 2), even with a fixed inclination of the tiltable backrest 2.

However, it should be taken into consideration that in the case of a position of the rod 8 attached to the bearing 11 (not shown in FIG. 2—only shown in FIG. 3) and seated in the arm 6 in the lower position (see FIG. 2), the weight of the user would push the eccentric disk 9 upwardly, if no particular counter-measurers were provided. These counter-measures consist of equipping a shell surface of the eccentric disk 9 with a lug 13. Then, in the lower position of the rod 8, the lug 13 rests against the stop 12 in the pedestal 10. The stop 12 in the pedestal 10 is offset by more than 180° in relation to the lowest bearing point of the lug 13, i.e., it is opposite the upper dead center. This prevents the weight of the user from creating a component that pushes in the direction of the upper dead center and could thus turn the eccentric disk 9 downwardly.

FIG. 3 and FIG. 4 incidentally also show the design configuration of the eccentric disk 9 in more detail. In other word, the eccentric disk 9 has four hexagonal recesses 15 therein, and is covered in the front thereof, by a front plate 14, wherein the front plate 14 has only one hexagonal recess. The lug 13 is also provided on the front plate 14. The handle 7 includes a hexagonal recess 16. As can be seen, this configuration allows the rod 8 to be guided through the hexagonal recess 15 in the eccentric disk 9 which is aligned with or corresponds to the hexagonal recess in the front plate 14. The lug 13 then rests opposite this hexagonal recess. An end of the rod 8 is pushed into the hexagonal recess 16 in the handle 7.

List of Reference Numerals

| | |
|---|---|
| 1 | Tiltable Seat |
| 2 | Tiltable Backrest |
| 3 | Base |
| 4 | Tilt Mechanism Housing |
| 5 | Backrest Support |
| 6 | Arm |
| 7 | Handle |
| 8 | Rod |

-continued

| | |
|---|---|
| 9 | Eccentric Disk |
| 10 | Pedestal |
| 11 | Bearing |
| 12 | Stop (in the Pedestal 10) |
| 13 | Lug (on the Eccentric Disk 9) |
| 14 | Front Plate (on the Eccentric Disk 9) |
| 15 | Hexagon Recess (in the Eccentric Disk 9) |
| 16 | Hexagon Recess (in the Handle 7) |

What is claimed as new and desired to be secured by Letters Patent of the United States is:

1. A chair with a tiltable seat and a tiltable backrest both mounted on a backrest support, the chair comprising:

a pedestal mounted on a bottom of the tiltable seat;

an eccentric disk seated in the pedestal so as to be movable therein;

a rod eccentrically penetrating the eccentric disk via a prismatically-shaped cross-section recess through the eccentric disk so that the rod is not movable with respect to the eccentric disk;

a handle connected on an outer end of the rod for use in turning the rod together with the eccentric disk; and an arm mounted on the backrest support of the tiltable backrest, wherein the rod is seated in the arm in a movable manner.

2. The chair of claim 1, wherein the rod has a prismatically-shaped cross-section and the rod penetrates the eccentric disk through said prismatically-shaped cross-section recess of the eccentric disk which corresponds to another prismatically-shaped cross-section recess in a front plate mounted on a front of the eccentric disk.

3. The chair of claim 1, wherein the handle includes a prismatically-shaped cross-section recess therein and the outer end of the rod is pushed into a prismatically-shaped cross-section recess in the handle so that the rod is connected to the handle in a stationary manner.

4. The chair of claim 2, wherein the prismatically-shaped cross-section of the rod is hexagonal and the prismatically-shaped cross-section recessed of the eccentric disk and the front plate mounted on the front of the eccentric disk are hexagonal.

5. The chair of claim 3, wherein the prismatically-shaped cross-section recess in the handle is hexagonal.

6. The chair of claim 1, wherein the eccentric disk has a shell surface and the shell surface of the eccentric disk includes a lug such that an end position of the eccentric disk rests against a stop in the pedestal.

7. The chair of claim 6, wherein the stop in the pedestal is offset by more than 180° in relation to a lowest bearing point of the lug.

* * * * *

UNITED STATES PATENT AND TRADEMARK OFFICE

CERTIFICATE OF CORRECTION

PATENT NO. : 6,588,844 B1
DATED : July 8, 2003
INVENTOR(S) : Stenzel

It is certified that error appears in the above-identified patent and that said Letters Patent is hereby corrected as shown below:

Title page, Item [54] and Column 1, line 1,
Title, should read -- [54] CHAIR WITH TILTABLE SEAT --

Signed and Sealed this

Twenty-first Day of October, 2003

JAMES E. ROGAN
*Director of the United States Patent and Trademark Office*